US007171141B2

(12) United States Patent
Abe et al.

(10) Patent No.: US 7,171,141 B2
(45) Date of Patent: Jan. 30, 2007

(54) CHARGING ROLLER, PROCESS CARTRIDGE AND ELECTROPHOTOGRAPHIC APPARATUS

(75) Inventors: Hiroshi Abe, Ibaraki (JP); Hirobumi Takahashi, Ibaraki (JP)

(73) Assignee: Canon Kasei Kabushiki Kaisha, Tsukuba (JP)

( * ) Notice: Subject to any disclaimer, the term of this patent is extended or adjusted under 35 U.S.C. 154(b) by 235 days.

(21) Appl. No.: 10/808,479

(22) Filed: Mar. 25, 2004

(65) Prior Publication Data

US 2004/0197115 A1 Oct. 7, 2004

(30) Foreign Application Priority Data

Apr. 7, 2003 (JP) ..... 2003-102894

(51) Int. Cl.
*G03G 15/02* (2006.01)

(52) U.S. Cl. ..... 399/176

(58) Field of Classification Search ..... 399/176
See application file for complete search history.

(56) References Cited

U.S. PATENT DOCUMENTS 4,851,960 A 7/1989 Nakamura et al. ..... 361/225
4,967,231 A 10/1990 Hosoya et al. ..... 355/219
5,466,499 A * 11/1995 Takagi et al. ..... 428/36.9
2002/0039500 A1* 4/2002 Abe et al. ..... 399/176
2002/0086125 A1* 7/2002 Kakii et al. ..... 428/36.91
2003/0044199 A1* 3/2003 Funabashi ..... 399/176
2003/0161664 A1* 8/2003 Abe et al. ..... 399/176

FOREIGN PATENT DOCUMENTS

| | | |
|---|---|---|
| JP | 63-149669 | 6/1988 |
| JP | 5-2313 | 1/1993 |
| JP | 5-96648 | 4/1993 |
| JP | 6-58325 | 3/1994 |
| JP | 10-228156 | 8/1998 |

* cited by examiner

*Primary Examiner*—David M. Gray
*Assistant Examiner*—Ryan D. Walsh
(74) *Attorney, Agent, or Firm*—Fitzpatrick, Cella, Harper & Scinto

(57) ABSTRACT

A charging roller for a contact charging assembly is provided including a conductive substrate, an elastic layer which covers the periphery of the conductive substrate, and a seamless tube externally so fitted as to cover the periphery of the elastic layer. The seamless tube constitutes a surface layer of the charging roller, and the charging roller has a surface of 3.0 μm or less in ten-point average roughness (Rz jis 94) and 0.10 mm or less in roughness curve average length (RSm).

4 Claims, 3 Drawing Sheets

CHARGING ROLLER, PROCESS CARTRIDGE AND ELECTROPHOTOGRAPHIC APPARATUS

BACKGROUND OF THE INVENTION

1. Field of the Invention

This invention relates to a charging roller, a process cartridge and an electrophotographic apparatus. More particularly, it relates to a charging roller used in the contact charging of an electrophotographic photosensitive member; and a process cartridge and an electrophotographic apparatus which have such a charging roller.

2. Related Background Art

In recent years, as charging assemblies for electrophotographic photosensitive members, contact charging assemblies have been put into practical use. Compared with corona charging conventionally used, contact charging can control the generation of ozone involved with the charging of electrophotographic photosensitive members and can reduce power consumption necessary for the charging. Then, in particular, a roller charging system making use of a charging roller as a charging member is preferably used in view of the stability of charging.

In the roller charging system, a conductive elastic roller is brought into pressure contact with a member to be charged and a voltage is applied thereto to charge the member to be charged.

The charging is performed by causing electric discharge from a charging member (charging roller) to the member to be charged, and hence the charging of the member to be charged takes place upon application of a voltage not lower than a certain threshold voltage. For example, when the charging roller is brought into pressure contact with an organic photosensitive member (OPC) having a 25 μm thick photosensitive layer, the surface potential of the photosensitive member begins to rise upon application of a voltage of about 640 V or above as absolute value and, at voltages above that voltage, the photosensitive member surface potential linearly increases at an inclination 1 with respect to the applied voltage. This threshold voltage is hereinafter defined as charging start voltage Vth.

That is, in order to attain a photosensitive member's surface potential Vd considered necessary for electrophotography, a DC voltage of Vd+Vth higher than a voltage necessary for image formation must be applied to the charging roller. Such a method of applying only DC voltage to the contact charging member in this way is called DC charging.

In the DC charging, however, any environmental variations may cause variations in electrical resistance of the charging member, and also gradual changes in photosensitive-layer thickness caused by scrape of the photosensitive layer may cause variations in the Vth. For these reasons, it has not been easy to control the potential of the electrophotographic photosensitive member to the desired value, Accordingly, in order to achieve more uniform charging, an AC+DC charging system is used in which a voltage formed by superimposing an AC component with a 2×Vth or higher peak-to-peak voltage on a DC component corresponding to the desired Vd e.g., Japanese Patent Application Laid-Open No. S63-149669. This is a system aiming at a potential-leveling effect which is attributable to AC, where the potential of the member to be charged converges to the Vd, the middle of the peak of AC voltage, and may hardly be affected by external disturbance such as environmental variations.

As the charging roller, there is an example in which using a conductive seamless tube a surface layer is formed on a conductive support member e.g., U.S. Pat. No. 4,967,231. There are also disclosed a seamless composed of a fluorine resin e.g., Japanese Patent Application Laid-Open No. H05-2313, and a multi-layer tube formed of layers having different conductivities e.g., Japanese Patent Application Laid-Open No. H05-96648. As a method for manufacturing such charging rollers, a method for formation by insertion is mentioned as the above conventional techniques. Also there is disclosed a method of forming the surface layer by means of a crosshead extruder e.g., Japanese Patent Application Laid-Open No. H06-58325.

Such methods of forming the charging roller by using the seamless tube enables smooth surfaces to be formed even when foam is used as an elastic layer formed on a substrate, because they may further be covered with the seamless tube. Thus, the member to be charged can more uniformly be charged.

As a specific method by which the support member is covered with the seamless tube, a method is available in which the tube is externally fitted to the support member. Stated specifically, there is a method in which the seamless tube is formed to have an inner diameter larger than the outer diameter of the support member to be covered and then the tube is contracted by a physical or chemical means, e.g., by heat, or a method in which the seamless tube is formed to have an inner diameter smaller than the outer diameter of the support member to be covered and the tube is spread out and fitted to the support member by a physical or chemical means, e.g., by air pressure e.g., Japanese Patent Application Laid-Open No. H10-228156.

Where a developer (toner and external additives) adheres to the charging roller surface via an electrophotographic photosensitive member, the electrical resistance of the charging roller surface may change or the electrical resistance may come non-uniform, and this consequently may make it unable to charge the electrophotographic photosensitive member stably and in a good state, and furthermore to obtain good electrophotographic images. Accordingly, in order to obtain high-grade electrophotographic images stably, it is important for the charging roller to be endowed with such surface properties that can keep the developer from adhering to the charging roller surface. Here, in the charging roller having the construction in which the seamless tube is externally fitted to the periphery of an elastic layer, the present inventors have not found any examples in which the elastic layer is surely covered with the seamless tube and simultaneously more improved in surface properties.

SUMMARY OF THE INVENTION

Accordingly, an object of the present invention is to provide a charging roller that can more surely keep the developer from adhering to the surface of the charging roller in which an elastic layer covering the periphery of a mandrel is covered with a seamless tube externally fitted to the periphery of the elastic layer to form a surface layer.

Another object of the present invention is to provide a process cartridge and an electrophotographic apparatus which have a charging roller that can more surely keep the developer from adhering to the surface of the charging roller in which an elastic layer covering the periphery of a mandrel is covered with a seamless tube externally fitted to the periphery of the elastic layer to form a surface layer, and can give high-grade electrophotographic images stably.

A first embodiment of the present invention provides a charging roller for a contact charging assembly, comprising-a conductive substrate, an elastic layer which covers the periphery of the conductive substrate, and a seamless tube externally so fitted as to cover the periphery of the elastic layer, wherein the seamless tube constitutes a surface layer of the charging roller, and wherein the charging roller has a surface of 3.0 μm or less in ten-point average roughness (Rz jis 94) and 0.10 mm or less in roughness curve average length (RSm).

Another embodiment of the present invention provides a process cartridge comprising an electrophotographic photosensitive member and the above charging roller which are integrally supported together, and being detachably mountable on the main body of an electrophotographic apparatus.

Still another embodiment of the present invention provides an electrophotographic apparatus comprising an electrophotographic photosensitive member and the above charging roller.

DESCRIPTION OF THE PREFERRED EMBODIMENTS

Embodiments of the present invention are described below in detail.

Figure 1:
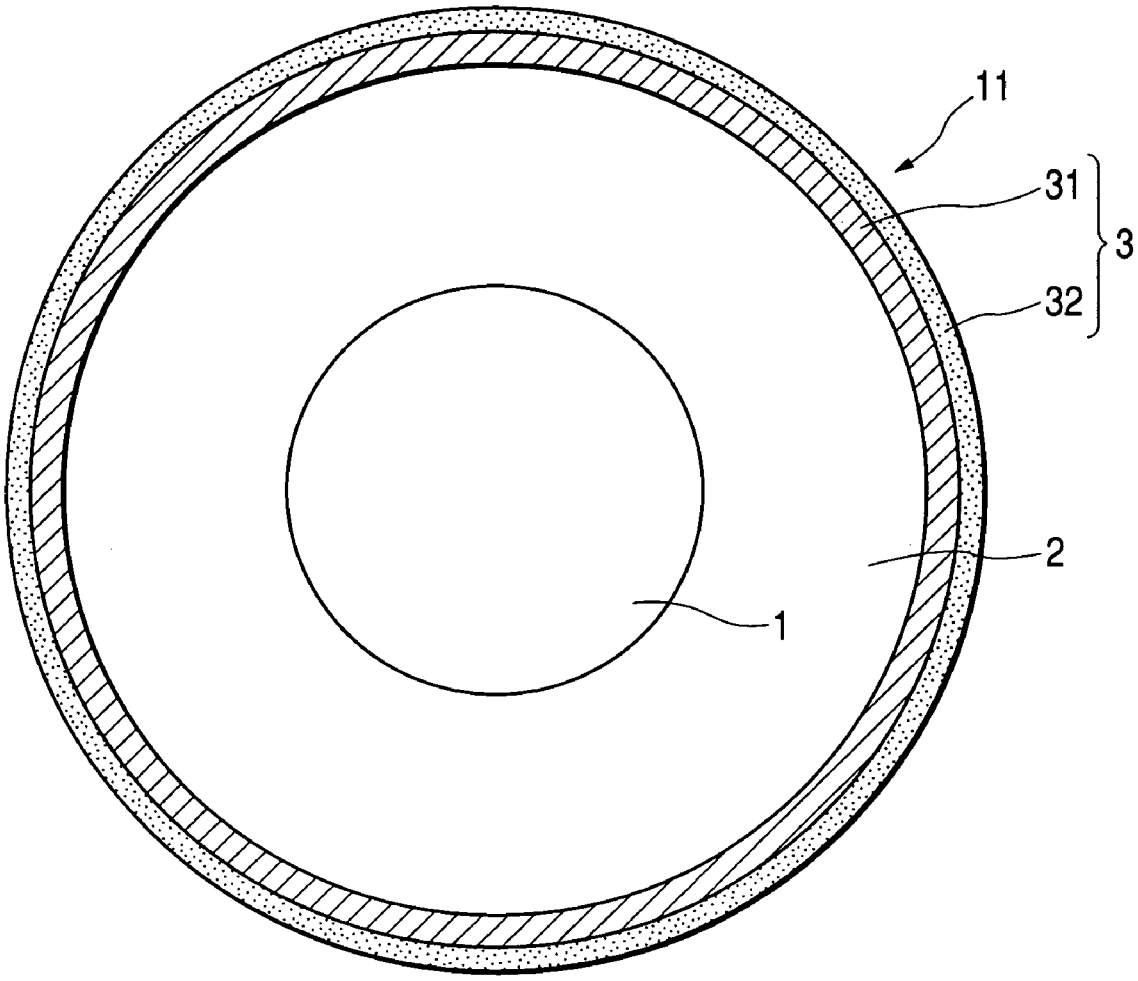
FIG. 1 illustrates an example of the construction of the charging roller of the present invention.

An example of the construction of a charging roller according to an embodiment of the present invention is shown in FIG. 1. A charging roller 11 has a conductive mandrel 1, an elastic layer 2 which covers the periphery of the conductive mandrel 1, and a seamless tube 3 fitted externally to the periphery of the elastic layer 2. The seamless tube 3 constitutes the surface layer of the charging roller 11. Here, the seamless tube 3 has a multi-layer structure comprised of a first layer 31 and a second layer 32. The conductive mandrel 1 and the elastic layer 2 constitute a support member as described later.

In the present invention, the surface of the charging roller has a ten-point average roughness (Rz jis 94) of 3.0 μm or less. Although there are no particular limitations on its lower limit, about 1.0 μm is an actual lower limit. The surface of the charging roller has a roughness curve average length (RSm) of 0.10 mm or less, preferably 0.08 mm or less. Its actual lower limit is about 0.04 mm.

Such construction enables the developer to be very effectively kept from adhering to the charging roller surface.

In addition, the ten-point average roughness (Rz jis 94) referred to in the present invention is the value found according to JIS B 0601:1994, and the standard length necessary for calculating the Rz jis 94 is set to be 2.5 mm. The RSm is "the average value of a length Xs of the roughness curve factor in a standard length" found according to JIS B 0601:2001. Here, the standard length is 2.5 mm. Also, the minimum height used in calculating the RSm is defined as 10% of the maximum height of profile (roughness) of the roughness curve in JIS B 0601:2002.

As the seamless tube constituting the surface layer of the charging roller according to the present invention, it may be formed of a blend of rubber particles and a thermoplastic elastomer. Here, as a specific example of the rubber particles, it may include those containing EPDM (ethylene-propylene-diene-methylene) cross-linked rubber particles contained in high-impact polystyrene (HIPS) or the like. There are no particular limitations on particle diameter, shape and so forth of the rubber particles, which may be any diameter and shape as long as the ten-point average roughness (Rz jis 94) and roughness curve average length (irregularity average distance) (RSm) according to the present invention are satisfied.

As a specific example of the seamless tube according to the present invention, it may include a seamless tube composed of, e.g., a two-component resin having (A) a thermoplastic styrene elastomer and (B) HIPS, and (C) carbon black as a conducting agent.

Stated specifically, the component-(A) thermoplastic styrene elastomer may include poly(styrene-hydrogenated butadiene-crystal olefin) block terpolymer (SEBC), poly (styrene-hydrogenated butadiene-styrene) block terpolymer (SEBS), poly(styrene-butadiene-styrene) block terpolymer (SBS), poly(styrene-hydrogenated isoprene-styrene) block terpolymer (SEPS), and poly(styrene-vinylisoprene-styrene) block terpolymer.

Meanwhile, as the component-(B) resin, it may preferably be impact-resistant polystyrene (HIPS), and particularly preferably be impact-resistant polystyrene containing EPDM cross-linked rubber particles.

As to the proportion of component (A) to component (B), it may preferably be (A)/(B)=80/20 to 40/60 in weight ratio, and may particularly preferably be 60/40 to 40/60. By controlling the proportion within this range, the stated surface roughness can be brought about, and also can remedy the tendency of the developer to adhere to the charging roller surface. Also, there is no problem concerning the tube becoming too hard or developing poor elastic properties which would prohibit the tube from covering the elastic layer, or even if it were able to do so, the roller may be in such a poor shape as to make it difficult to be usable as the charging roller.

As to the composition of base resins of the seamless tube, by blending the thermoplastic styrene elastomer and the HIPS, the surface roughness can, be suitably controlled. Moreover, the rubber component contained in the HIPS has the effect of bringing the RSm (irregularity average distance) into 0.10 mm or less. In the present invention, the RSm value is made small to reduce the contact area of the roller surface coming in contact with the toner and external additives so that the effect of lowering the tendency of the toner and external additives to adhere to the roller surface is brought out.

The component (C) carbon black may be used in a proportion of from 10% to 60% by weight, particularly preferably from 20% to 40% by weight, based on the total weight of the solid matter of the seamless tube. By controlling the proportion within this range, it can be prevented that the durability required for the charging roller is lowered due to an increase in resistance when used under electrification or that the tube becomes too hard and has so poor elasticity that it can not externally be fitted to the elastic layer.

The component (C) carbon black may be any types of carbon black as long as it can impart to the seamless tube a volume resistivity of from $1\times10^{6}$ to $1\times10^{11}$ Ω·cm and satisfies the above content. Two or more types of carbon black may also be used in combination.

As to the component (C) carbon black, it may include, e.g., as commercially available products, KETJEN BLACK (available from Lion Akzo Co., Ltd.); PRINTEX, SPECIAL BLACK and COLOR BLACK (available from Degussa Japan Ltd.); BLACK PEARLS (available from Cabot Corporation); ASAHI CARBON (available from Asahi Carbon Co., Ltd.); MITSUBISHI CARBON (available from Mitsubishi Chemical Corporation.); DENKA BLACK (available from Denki Kagaku Kogyo Kabushiki Kaisha); SEAST and TOKA BLACK (all available from Tokai Carbon Co., Ltd.).

Additives other than the foregoing, which may optionally be used, may include a conductive filler, an antioxidant, a softening agent, a plasticizer, a reinforcing agent and a filler. As the conductive filler, other than the above carbon black as being essential, graphite and metal oxides may be used. The metal oxides may include, e.g., titanium oxide and zinc oxide.

Next, referring to an embodiment of a method for producing the seamless tube according to the present invention, it may be produced by kneading the thermoplastic styrene elastomer, the HIPS and the carbon black together with some optional additives, subsequently pelletizing the kneaded product, and thereafter extruding the resultant pellets into a cylindrical tube by means of an extruder. Then, the seamless tube thus fabricated is externally fitted to the support member to make up a conductive member which is the charging roller.

The thickness of the seamless tube according to the present invention is not particularly limited, but is preferably in a range from 100 μm to 600 μm. The tube may be a multi-layer extrusion tube.

There is exemplified below the constitution and material of a support member to which the seamless tube according to the present invention is to be externally fitted, and a method by which the seamless tube is externally fitted to the support member.

As to a form of the support member, it may include an elastic roller. In regard to materials of the support member, there are used metals such as iron, copper and stainless steel, carbon-dispersed resins, and metal- or metal-oxide-dispersed resins, as materials for the conductive substrate. It may have the shape of a rod or a plate. The elastic roller may be so constructed that the elastic layer is provided on the conductive substrate. Also, a conductive layer or a resistance layer may further be provide on the outside of the elastic layer.

The elastic layer may be formed using any of rubbers such as chloroprene rubber, isoprene rubber, EPDM rubber, polyurethane rubber, epoxy rubber and butyl rubber, or sponge, or thermoplastic resins such as styrene-butadiene, polyurethane, polyester and ethylene-vinyl acetate. These rubbers or resins may be incorporated with a conducting agent such as carbon black or metal or metal oxide particles.

As the conducting layer, there may be used, for example, a metal vacuum-deposited film, a conductive-particle-dispersed resin or a conductive resin. The metal vacuum-deposited film may include vacuum-deposited films of aluminum, indium, nickel, copper and iron. The conductive-particle-dispersed resin may include resins such as urethane, polyester, vinyl acetate-vinyl chloride copolymer and polymethyl methacrylate in which conductive particles of any of carbon, aluminum, nickel, titanium oxide and the like have been dispersed. The conductive resin may include quaternary-ammonium-salt-containing polymethyl methacrylate, polyvinyl aniline, polyvinyl pyrrole, polydiacetylene and polyethylene imine.

For the resistance layer, a conductive resin and a conductive-particle-dispersed insulating resin may be used. The conductive resin may include resins such as ethyl cellulose, nitro cellulose, methoxymethylated polyamide, ethoxymethylated polyamide, copolymer polyamide, polyvinyl hydrin and casein. Examples of the conductive-particle-dispersed insulating resin may include insulating resins such as urethane, polyester, vinyl acetate-vinyl chloride copolymer and polymethyl methacrylate in which conductive particles of any of carbon, aluminum, indium oxide, titanium oxide and the like have been dispersed.

The charging roller, having the support member and the seamless tube, constituted according to the present invention, has superior manufacturing stability, and the medium-resistance region which have ever been considered difficult to produce stably can be stably developed.

In respect to a method in which the seamless tube according to the present invention is externally fitted to the elastic layer to covers its periphery, there are no particular limitations thereon. For example, a method may be employed in which the seamless tube is formed by extrusion to have an inner diameter smaller than the outer diameter of the elastic roller to be covered, and thereafter the inner diameter of the seamless tube is enlarged by utilizing air pressure or the like, and the elastic roller is inserted into the enlarged seamless tube which is brought into close contact with the periphery of the elastic roller by its own shrinkage force; or a method in which the seamless tube is a heat-shrinkable tube, and after having been put over the elastic roller, is heated to shrink and come into close contact with the periphery of the elastic roller.

There are no particular limitations on the electrophotographic photosensitive member, an exposure means, a developing means, a transfer means and a cleaning means which are used in the present invention.

Figure 2:
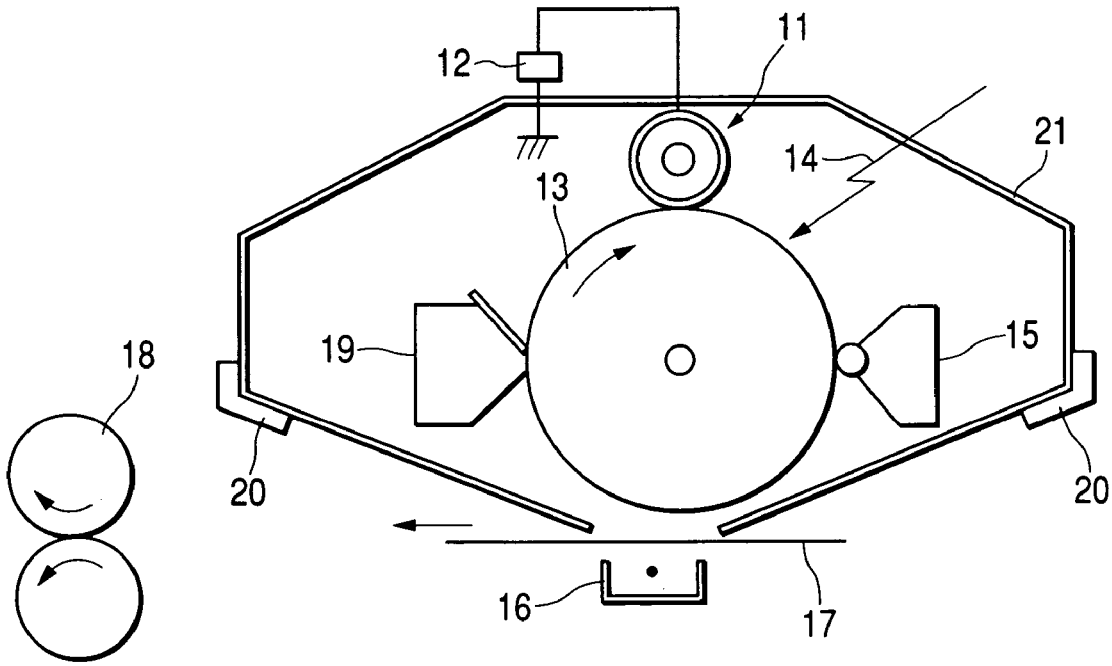
FIG. 2 schematically illustrates the construction of an electrophotographic apparatus provided with a process cartridge having the charging roller of the present invention as a primary charging means.

FIG. 2 shows a schematic cross-section of an electrophotographic apparatus in which a process cartridge having the charging roller 11 of the present invention as a primary charging means is set in the main body of an electrophotographic apparatus through a guide means.

In FIG. 2, reference numeral 13 denotes an electrophotographic photosensitive member, which is rotated in the direction of an arrow at a stated peripheral speed. The photosensitive member 13 is, in the course of its rotation, uniformly electrostatically charged on its periphery to a positive or negative, given potential through the charging roller 11 of the present invention as a primary charging means, and then exposed to exposure light 14 emitted from an exposure means (not shown) for slit exposure or laser beam scanning exposure. In this way, electrostatic latent images are successively formed on the periphery of the photosensitive member 13.

The electrostatic latent images thus formed are subsequently developed with a toner by the operation of a developing means 15. The toner-developed images thus formed by development are then successively transferred by the operation of a transfer means 16, to a transfer medium 17 fed from a paper feed section (not shown) to the part between the photosensitive member 13 and the transfer means 16 in such a manner as synchronized with the rotation of the photosensitive member 13.

The transfer medium 17 to which the images have been transferred is separated from the surface of the photosensitive member, is guided into a fixing means 18, where the images are fixed, then is discharged from the apparatus as a reproduction of an original (a copy).

The surface of the photosensitive member 13 from which images have been transferred is brought to the removal of the toner remaining after the transfer, through a cleaning means 19. Thus the photosensitive member is cleaned on its surface, and is repeatedly used for the formation of images.

In the present invention, the apparatus may be constituted of a combination of plural components held in a container and integrally joined as a process cartridge from among the constituents such as the above photosensitive member 13, the charging roller 11, the developing means 15 and the cleaning means 19 so that the process cartridge is detachably mountable to the body of the electrophotographic apparatus such as a copying machine or a laser beam printer. For example, at least one of the developing means 15 and the cleaning means 19 may integrally be supported in a cartridge together with the photosensitive member 13 and the charging roller 11, to form a process cartridge 21 that is detachably mountable to the main body of the apparatus through a guide means 20 such as rails provided in the main body of the apparatus.

EXAMPLES

The present invention is described below in greater detail by giving specific working examples. The embodiments of the present invention, however, are by no means limited to these. In the following Examples and Comparative Examples, "part(s)" refers to "part(s) by weight".

In these working examples, double-layer simultaneous extrusion tubes are produced in the following way.

Figure 3:
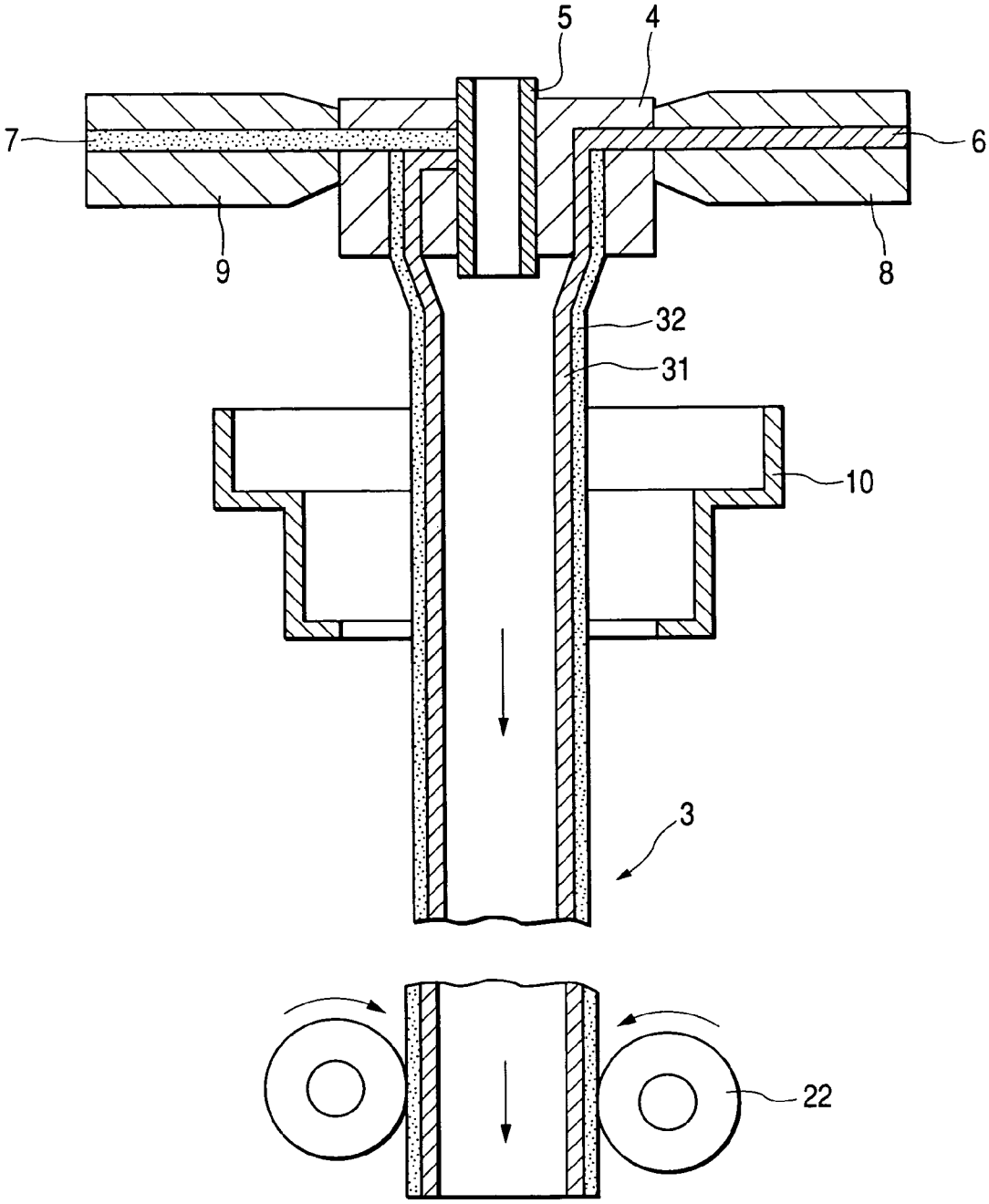
FIG. 3 schematically illustrates the construction of a seamless-tube fabrication means in an apparatus for manufacturing the charging roller comprising a seamless tube according to the-present invention.

As shown in FIG. 3, a die 4 used in extrusion is provided with inner and outer double circular extrusion channels 6 and 7 around an air-introducing center through-hole 5. At the time of extrusion, an inner-layer extrusion material and an outer-layer extrusion material are pressure-injected into the inside channel 6 and the outside channel 8 from a first extruder 8 and a second extruder 9, respectively, and are extruded in such a way that an inner layer 31 and an outer layer 32 are superposed in an integral form to obtain a double-layer simultaneous extrusion tube 3, which is then cooled through a water-cooling ring 10 provided along the periphery of the double-layer simultaneous extrusion tube 3, and this is pulled by means of a tube take-off assembly 22. The tube is then successively cut in a stated length. In the next step, the tube thus cut is, as a seamless tube for the charging roller, externally fitted to the periphery of an elastic roller having a foamed elastic layer (the elastic layer 2) provided on the conductive substrate (mandrel) 1.

As a specific method by which the seamless tube is externally fitted, the seamless tube is first formed by extrusion to have an inner diameter equal to or smaller than the outer diameter of the support member, and then the inner diameter of the seamless tube is enlarged by, e.g., pressure so as to be externally fittable, where the support member is covered with the seamless tube through a means by which the support member is inserted thereinto.

Thus, a tube of double-layer film having a thin-gage layer which has been difficult to use singly as a covering tube can be easily produced by forming the seamless tube by multi-layer simultaneous extrusion.

The seamless tube 3 thus obtained is externally fitted to the periphery of the elastic roller to make up the charging roller 11 like that shown in FIG. 1.

Seamless Tube

Example & Comparative Example 1

As resins constituting the surface layer 32 (o) of the seamless tube 3, SEBC (styrene content: 20%) and HIPS were blended in proportions varied to SEBC/HIPS=0/100, 20/80, 40/60, 60/40, 80/20 and 100/0 in weight ratio, to each of which 5 parts of KETJEN BLACK EC, 20 parts of SPECIAL BLACK 250, 10 parts of magnesium oxide and 1 part of calcium stearate were added. These were kneaded at 180° C. for 15 minutes by means of a pressure kneader. The kneaded product obtained was cooled and then pulverized, and thereafter the pulverized product was pelletized by means of an extruder for granulation. Here, one in which SEBC/HJPS was in the proportion of 0/100 was designated as sample No. 1-1; and the rest 20/80 as No. 1-2, 40/60 as No. 1-3, 60/40 as No. 1-4, 80/20 as No. 1-5, and 100/0 as No. 1-6.

To 100 parts of thermoplastic polyurethane elastomer (TPU) as a resin constituting the inner layer 31 of the seamless tube 3, 16 parts of KETJEN BLACK EC, 10 parts of magnesium oxide and 1 part of calcium stearate were added. These were kneaded at 180° C. for 15 minutes by means of a pressure kneader. The kneaded product obtained was cooled and then pulverized, and thereafter the pulverized product was pelletized by means of an extruder for granulation.

Using the above pellets for the respective layers, extrusion was carried out by means of a double-layer extruder having a die of 16.5 mm in inner diameter and a point of 18.5 mm in outer diameter, followed by sizing and cooling, through the steps of which the extruded products were fabricated into seamless tubes (sample Nos. 1-1 to 1-6) each having an inner diameter of 11.1 mm, a surface layer thickness of 100 μm and an inner-layer thickness of 400 μm.

Seamless Tube

Comparative Example 2

To 60 parts of SEBC (styrene content: 20%) and 40 parts of GPPS (general-purpose polystyrene) as resins for the tube surface layer, 5 parts of KETJEN BLACK, 20 parts of SPECIAL BLACK 250, 10 parts of magnesium oxide and 1 part of calcium stearate were added. These were kneaded at 180° C. for 15 minutes by means of a pressure kneader. The kneaded product obtained was cooled and then pulverized, and thereafter the pulverized product was pelletized by means of an extruder for granulation. Thereafter, through the same production steps as those in Seamless Tube Example and Comparative Example 1, the extruded product was fabricated into a seamless tube (sample No. 2) having an inner diameter of 11.1 mm, a surface layer thickness of 100 μm and an inner-layer thickness of 400 μm.

As in the charging roller shown in FIG. 1, a conductive substrate 1 formed of a good-conductive material such as stainless steel, plated steel, brass or conductive plastic was provided on the periphery thereof with a foamed elastic layer 2 formed of a conductive elastic material, and further, to the periphery of this foamed elastic layer 2, the above seamless tubes (sample Nos. 1-1 to 1-6 and 2) were each externally fitted to make up charging rollers. The charging rollers thus obtained were each set in the process cartridge shown in FIG. 2.

The surface roughness (Rz jis 94) and hill-and-dale average distance (RSm) were measured according to JIS B 0601:1994. In reference to measurement conditions, measurement length was set to be 2.5 mm, measurement speed 0.5 mm/min, and cut-off wavelength 0.8 mm.

To evaluate the tendency of toner adhesion, the charging rollers were each set in the process cartridge shown in FIG. 2, and images were continuously reproduced on 1,000 sheets, where the charging roller surfaces after image reproduction were visually inspected, and evaluation was made on how the toner adhered thereto according to the following criteria. The evaluation results are shown in Table 1.

A: Toner is seen to slightly adhere.

B: Toner is seen to adhere, but within a tolerable range.

C: Toner components adhered in a large quantity.

Using the same rollers, images were further continuously reproduced on 10,000 sheets, and evaluation was made on how faulty images coming from toner adhesion appeared according to the following criteria. The evaluation results are shown in Table 1.

A: Faulty images coming from toner adhesion are little seen on images reproduced.

B: Black lines coming from toner adhesion are slightly seen, but within a tolerable range.

C: Faulty images (black lines) coming from toner adhesion appear clearly.

TABLE 1

| | Seamless tube No.: | | | | | | |
|---|---|---|---|---|---|---|---|
| | 1-1 (Cp) | 1-2 (Cp) | 1-3 (Ex) | 1-4 (Ex) | 1-5 (Ex) | 1-6 (Cp) | 2 (Cp) |
| (A) Styrene elastomer: | | | | | | | |
| Type | — | SEBC | SEBC | SEBC | SEBC | SEBC | SEBC |
| (pbw) | 0 | 20 | 40 | 60 | 80 | 100 | 60 |
| (B) Polystyrene resin: | | | | | | | |
| Type | HIPS | HIPS | HIPS | HIPS | HIPS | HIPS | GPPS |
| (pbw) | 100 | 80 | 60 | 40 | 20 | 0 | 40 |
| (A)/(B): | 0/100 | 20/80 | 40/60 | 60/40 | 80/20 | 100/0 | 60/40 |
| Rz jis 94 (μm) | * | 2.9 | 3.0 | 2.7 | 2.0 | 1.4 | 2.8 |
| RSm (mm): | * | 0.14 | 0.08 | 0.08 | 0.10 | 0.14 | 0.16 |
| Toner adhesion to roller surface: | * | C | B | A | B | C | C |
| Image evaluation: | * | C** | A | A | B | C** | C** |

(Cp): Comparative Example;
(Ex): Example
*Seamless tube was not externally fittable.
**Black lines appeared.

As can be seen from the foregoing, by controlling the content of the component (B) HIPS to be in the stated proportion, the surface roughness Rz jis 94 can be brought into 3.0 μm or less and the irregularity average distance RSm can be brought to 0.10 mm or less, where, with such control, the tendency of toner adhesion was greatly lowered and the faulty images coming from toner adhesion came not to easily occur. On the other hand, in the charging roller according to Comparative Example 2 in which the GPPS (general-purpose polystyrene) having no rubber component is used as the base resin, the RSm was unable to be sufficiently reduced. Hence, the developer was seen to adhere to the charging roller surface, and electrophotographic images formed by using such a charging roller also were poor.

As described above, the present invention has made it possible to provide a charging roller which can keep the developer (having, e.g., toner and external additives) from adhering to the charging roller surface, and can achieve stable and good uniform charging performance and reproduced-image quality; and a process cartridge and an electrophotographic apparatus having this charging roller.

What is claimed is:

1. A charging roller for a contact charging assembly, said charging roller comprising:

a conductive substrate;

an elastic layer which covers the periphery of the conductive substrate; and a seamless tube externally so fitted as to cover the periphery of the elastic layer, wherein said charging roller has a surface of 3.0 μm or less in ten-point average roughness Rz jis 94, and 0.04 mm or more and 0.10 mm or less in roughness curve average length RSm, and wherein said seamless tube constitutes a surface layer of the charging roller, said seamless tube comprising:

(A) a thermoplastic styrene elastomer; and (B) a high-impact-resistant polystyrene (HIPS) containing rubber particles, wherein a proportion of the component (A) to the composition (B) is (A)/(B) in a range of 80/20 to 40/60 in weight ratio.

2. The charging roller according to claim 1, wherein said seamless tube comprises a multi-layer structure.

3. A process cartridge comprising an electrophotographic photosensitive member and the charging roller according to claim 1, which are integrally supported together, and are detachably mountable on a main body of an electrophotographic apparatus.

4. An electrophotographic apparatus comprising an electrophotographic photosensitive member and the charging roller according to claim 1.

* * * * *

UNITED STATES PATENT AND TRADEMARK OFFICE

CERTIFICATE OF CORRECTION

PATENT NO. : 7,171,141 B2
APPLICATION NO. : 10/808479
DATED : January 30, 2007
INVENTOR(S) : Hiroshi Abe et al.

It is certified that error appears in the above-identified patent and that said Letters Patent is hereby corrected as shown below:

COLUMN 1:
Line 61, “desired Vd” should read --desired, Vd,--.

COLUMN 2:
Line 2, “tube” should read --tube,--.
Line 10, “Also” should read --Also,--.
Line 37, “come” should read --become--.

COLUMN 3:
Line 3, “ing-a” should read --ing a--.
Line 33, “the-present” should read --the present--.

COLUMN 4:
Line 64, “can not” should read --cannot--.

COLUMN 5:
Line 48, “provide” should read --provided--.

COLUMN 6:
Line 22, “covers” should read --cover--.

COLUMN 9:
Line 58, “came not to” should read --did not--.

Signed and Sealed this

Thirty-first Day of July, 2007

JON W. DUDAS
*Director of the United States Patent and Trademark Office*